US005531033A

United States Patent [19]

Smith et al.

[11] Patent Number: 5,531,033

[45] Date of Patent: Jul. 2, 1996

[54] CONTROLLED PROFILE DRYING HOOD

[75] Inventors: Rodney M. Smith, Pointe Claire; Daniel J. J. Poirier, Pincourt, both of Canada

[73] Assignee: Asea Brown Boveri, Inc., LaSalle, Canada

[21] Appl. No.: 325,041

[22] Filed: Oct. 18, 1994

[51] Int. Cl.[6] ..... F26B 11/02

[52] U.S. Cl. ..... 34/117; 34/120; 162/193

[58] Field of Search ..... 34/111, 114, 11, 34/120, 123; 162/193

[56] References Cited

U.S. PATENT DOCUMENTS

| | | | |
|---|---|---|---|
| 3,167,408 | 1/1965 | Justus et al. | 34/122 |
| 3,183,607 | 5/1965 | Beachler | 34/122 |
| 3,816,941 | 6/1974 | Holik et al. | 34/123 |
| 3,855,713 | 12/1974 | Portouw | 34/122 |
| 3,930,319 | 1/1976 | Coleman | 34/122 |
| 4,096,643 | 6/1978 | Futcher | 34/122 |
| 4,168,580 | 9/1979 | Weinmann | 34/122 |
| 4,763,424 | 8/1988 | Taylor et al. | 34/114 |
| 4,942,675 | 7/1992 | Sundovist | 34/23 |
| 5,317,817 | 6/1994 | Roberts et al. | 34/120 |
| 5,425,852 | 6/1995 | Joiner | 34/123 |

FOREIGN PATENT DOCUMENTS

| | | | |
|---|---|---|---|
| 297422 | 2/1930 | Canada . | |
| 364124 | 2/1937 | Canada . | |
| 648526 | 9/1962 | Canada | 34/48.1 |
| 688137 | 6/1964 | Canada | 34/23 |

*Primary Examiner*—John T. Kwon
*Attorney, Agent, or Firm*—Konneker & Bush

[57] ABSTRACT

Apparatus is disclosed to control Yankee hood profile along the cylinder surface so as to provide a structurally stable hood having controlled impingement distances at operating temperatures. Radial support of the hot hood internals are located at or near the extremities of the hood wrap and the internal profile along the cylinder wrap is on an adjusted cold shape so that the profile is even when operating temperatures are reached. Thus, the hood is "deformed" (not pre-strained) when cold but, when the operating temperature is reached, it assumes the desired configuration.

4 Claims, 7 Drawing Sheets

CONTROLLED PROFILE DRYING HOOD

FIELD OF THE INVENTION

The present invention relates to Yankee Hood Dryers and in particular to an apparatus and method for a structurally stable Yankee Hood that provides controlled impingement distances at operating temperatures.

BACKGROUND OF THE INVENTION

Yankee type hoods are among the main elements in paper web drying processes and, specifically, a Yankee hood is an air distribution and drying system which operates at high temperatures. The hood is shaped to be installed over a portion of the circumferential surface of a rotatable drying cylinder. The moving web material to be dried travels over, and with, the portion of the rotating cylinder. The internal structure of the hood includes an air distribution system which conveys and directs hot, drying air onto the web travelling over the cylinder. A return air system in the hood utilizes space not occupied by the air distribution system and also includes the enveloping enclosure over the internal elements of the hood.

As described above, the hood is shaped for installation over the cylinder. The distance between the air distribution nozzles of the hood internals and the surface of the cylinder is referred to as the "impingement distance" and this is critical to a successful drying process. The shape or configuration of the hood near that distance is referred to as the hood profile. It will be appreciated that a good or fitting profile adjacent the cylinder ensures the best conditions for drying.

SUMMARY OF THE INVENTION

One of the problems with conventional Yankee hoods is that, as the operating temperature of the internals increase, the impingement distance becomes unstable. This is due to the fact that the materials of the hood are subject to changes in configuration or shape due to thermal expansion of the materials from the variations in temperature of the mechanism. The present invention addresses the problems of thermal expansion in hood structures by providing a combination of elements that results in controlled impingement distances at hot, operating temperatures in a structurally stable hood.

In order for the hood to have a better fit relative to the configuration of the cylinder in hot or operating conditions, it is manufactured to have a "cold" or "deformed" configuration which, after thermal expansion, takes on a "hot" shape that gives the best possible fit to the cylinder. As a result of this, a uniform hot impingement distance is attained.

In contrast, the hood profile will not be perfect if the hood is not operated in high temperature conditions. However, if a user does not operate the hood hot, it means that total drying capacity is not required and therefore a perfect profile is not critical.

The hood structure temperature varies during operation and the hood "grows" or "expands" due to temperature increases. The hood growth must at all times avoid interference with the cylinder. Hood growth was not a major concern in the past because the hood radius, when cold, was larger than the cylinder radius. As a result, the hood position could be adjusted, hot or cold, and it would not cause any interference with the cylinder. However, the impingement distances in hot conditions would vary along the hood wrap because the hood would have a tendency to move away from the cylinder as it was warming up. Such action is detrimental to the drying process.

In accordance with the present invention, the radius of the cold hood profile is smaller than the cylinder radius plus the impingement distance. The hood profile then moves toward the desired position as it is warming up. Because the hood structure temperature varies during operation, a guiding system is desirable to ensure that the hood does not come into interference with the cylinder. A guiding system according to an embodiment of the invention is installed at each end of the hood wrap and this guarantees that there will be no interference between the hood profile and the cylinder as the two ends of the hood wrap are at all times closest to the cylinder.

In another embodiment of the invention, the guides are used to secure the profile position at any temperature. A circumferential support is used to control not only the profile but also the hood general thermal expansion. In this embodiment, support is located near the angular center of the hood wrap such that it is circumferentially fixed relative to the cylinder so that it restricts movements along the circumference but allows movements along the radius, thus minimizing displacement due to thermal expansion.

Thermal stress in the hood structure occurs when the operating temperatures differ throughout the assembly components. Because the components at different temperatures have different expansion rates, this can cause stress at their common joints. To minimize this type of stress, the hot elements or pieces of the hood are decoupled from the cold ones through connections. The hot pieces are the elements of the distribution system as they convey the hot air and they constitute the internals of the hood. The de-coupling of the hot internals from the outside walls of the hood reduce thermal stress.

According to a broad aspect, the invention relates to a Yankee type drying hood adapted for mounting adjacent a drying cylinder. The air distribution system or hood internals have a deformed, cold profile and an operative, hot profile with the internals of the hood being supported at or adjacent the extremities of the hood wrap or located such that the extremities of the hood wrap are located at the desired position. The arrangement is such that the hood internals are adjusted to the deformed profile when cold so that, when the operative temperatures are reached, the desired configuration or hot profile is assumed by the internals to provide a stable hood with controlled impingement distances at operating temperatures.

In accordance with another aspect, the hot internal structure is supported at two points at each end at or near the angular extremities of the hood wrap such that the radial position relative to the cylinder is fixed. The nozzle box profile will be manufactured to a calculated configuration which will result in uniform hot impingement distances. Accordingly, the impingement distance will be greater at the angular center of the hood wrap when the hood is cold.

The hot internal structure will be supported near the angular center of the hood wrap so that it is circumferentially fixed relative to the cylinder. The hood will have a cool outer structure, insulated on the inside, and which is only structurally connected to the hot internals at specified points.

In some cases, a bottom guiding system cannot be installed on the hood. However, along the radial displacement direction on the present headers of the air distribution system, there is a point which is subjected to practically no displacement. Accordingly, that specific location would become a fixed support point or neutral point. In this arrangement, a top sliding guide would remain adjacent the upper extremity of the hood wrap but the bottom guide would be eliminated.

DETAILED DESCRIPTION OF THE PREFERRED EMBODIMENT

Figure 1:
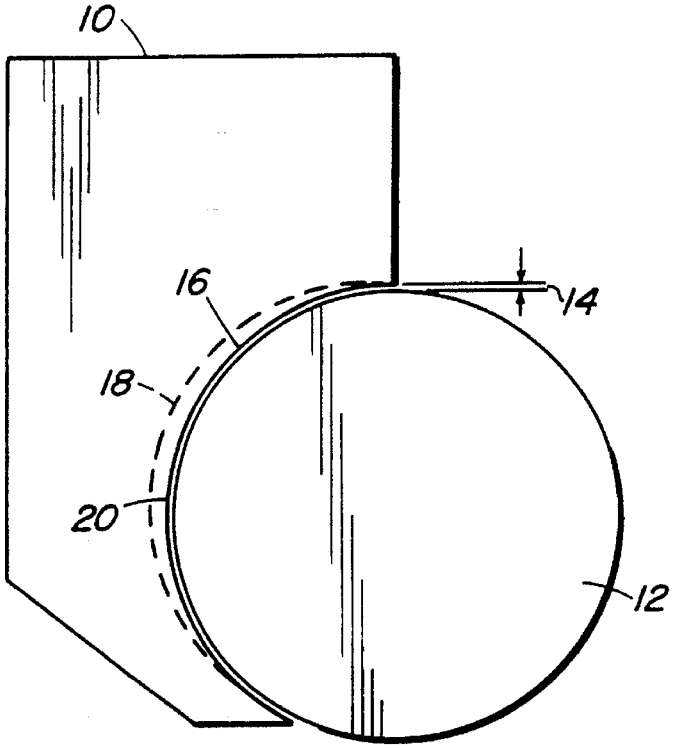
FIG. 1 is a schematic side elevation illustrating the concept of the present invention.
Figure 6:
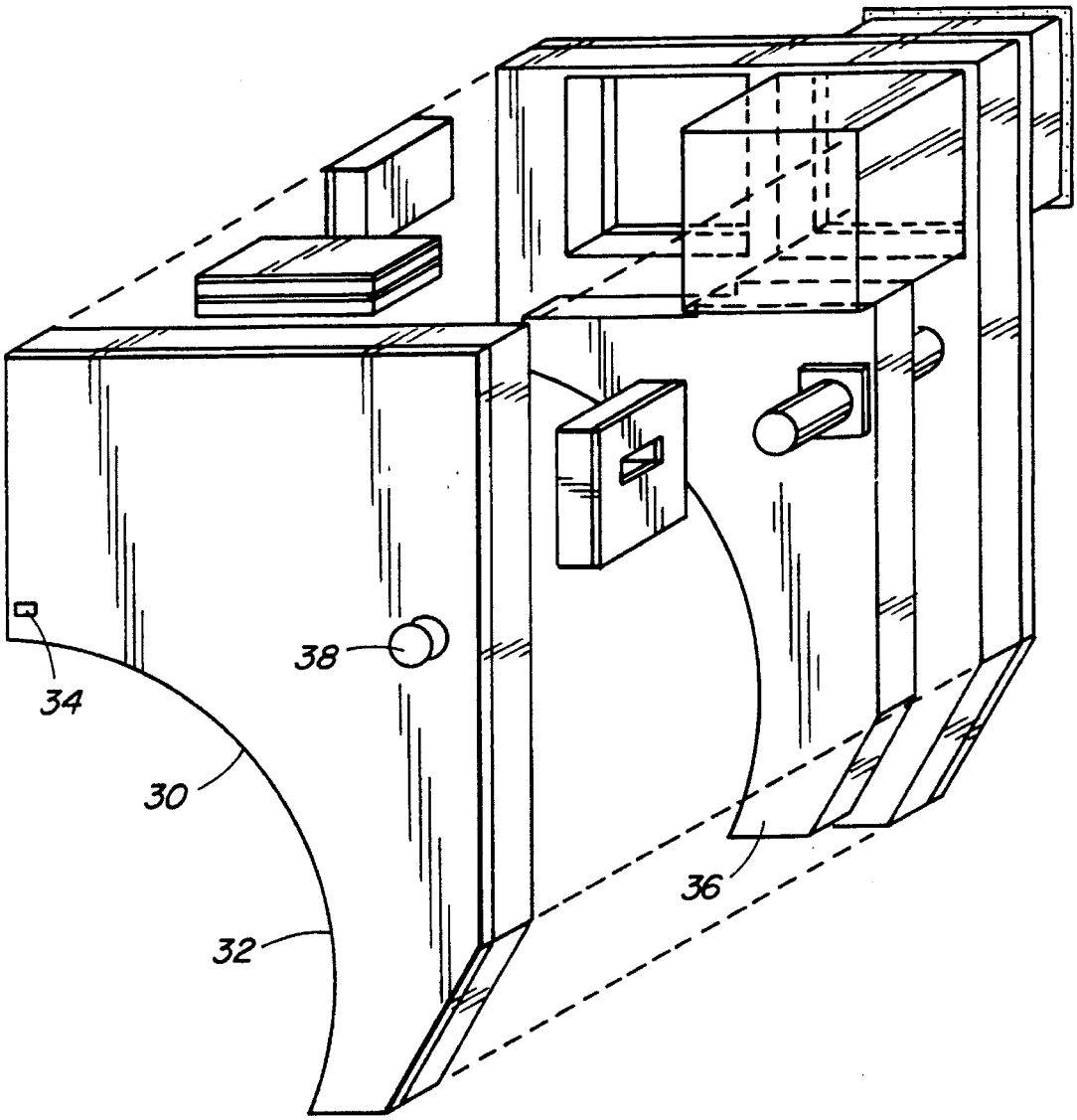
FIG. 6 is an isometric view showing portions of the internal and external portions of the hood.

FIG. 1 is a schematic side elevation view which illustrates the concept of the cold deformed hood. The hood 10, which includes an air distribution and drying system as shown for example in FIG. 6, is operated at high temperature and it is shaped to be installed over a cylinder 12 towards which drying air is impinged from crescent headers and nozzles (not shown) which constitute the internals of the hood structure. The distance between the hood 10 and the cylinder 12 is critical to the drying process and, as shown in FIG. 1, it is referred to as the impingement distance 14. The configuration or shape of the hood 10 near the impingement distance is referred to as the hood profile 16. It will be appreciated to those skilled in the art that a good hood profile adjacent the cylinder ensures the best conditions for drying.

In order for the hood 10 to have an optimum shape with respect to the cylinder 12 in hot, operating conditions, it will be manufactured to have a "cold"shape which will, after thermal expansion, result in a shape that will give the best possible fit to the cylinder; i.e. a uniformed, hot impingement distance. FIG. 1 shows, in a dashed line, the general location of the cold configuration 18 of the hood internals while the hot, operating configuration is shown in full line at 20. It will be understood that if a user does not operate the hood 10 in hot conditions, it will mean that total drying capacity is not required and thus an optimum profile is not critical.

Temperatures of the hood structure varies during operation and the hood internals grow or expand due to the temperature increases. A cold hood will have a temperature as low as room temperature whereas a hot, operating hood will have internal temperatures which could range from 260° C. (500° F.) and up. The growth of the hood 10 must at all times avoid interference with the cylinder 12. This has not been a major concern in the past mainly because the cold hood radius was larger than the radius of the cylinder 12 and as a result, the hood position could be adjusted hot and it would not cause any interference with the cylinder in the cooling or subsequent warming processes. However, the impingement distances in hot conditions in those past arrangements would vary along the hood wrap as the hood would have a tendency to move away from the cylinder while it was warming up and this did not help the drying process.

Figure 2:
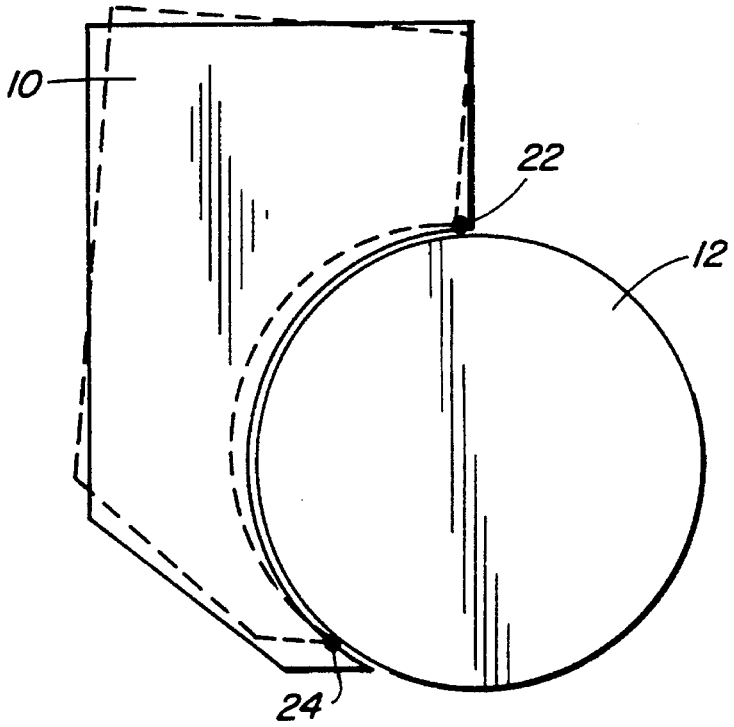
FIG. 2 is a view similar to FIG. 1 but illustrating the use of a two-point guiding and support system.
Figure 3:
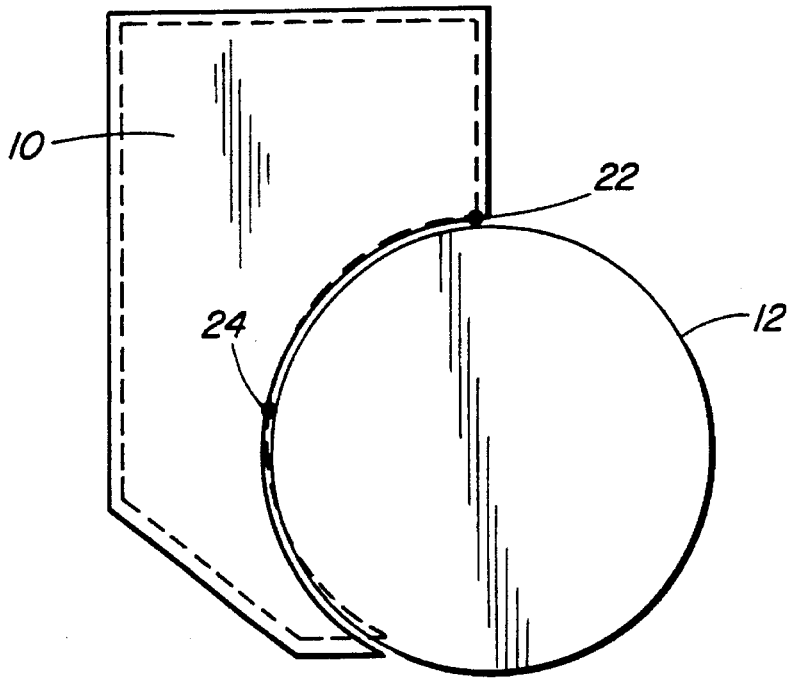
FIG. 3 is a further view similar to FIG. 1.

FIGS. 2 and 3 illustrate the concept of the profile edge guiding system for the hood internals, FIG. 3 showing an arrangement of the type to be avoided. In FIGS. 2 and 3, as in FIG. 1, the hot configuration is shown in full line and the cold configuration is shown in dashed line. As shown in FIG. 1, the radius of the cold, deformed profile is smaller than the radius of the cylinder 12. The profile then moves toward the desired position as it is warming up. Because the hood structure temperatures vary during operation, a guiding system is desirable to ensure that the hood 10 does not come into interference with the cylinder 12. FIG. 2 shows the concept of a two point guiding and support system located at the extremities of the hood wrap. Upper guides 22 and lower guides 24 are installed at each end of the hood wrap and this guarantees that, when expansion of the hood internals take place, there will be no interference with the cylinder 12 as the two ends of the hood wrap are at all times closest to the cylinder. It will be appreciated that if they were located anywhere along the profile, guides would not prevent interference as illustrated for example in the problem arrangement of FIG. 3.

Figure 4:
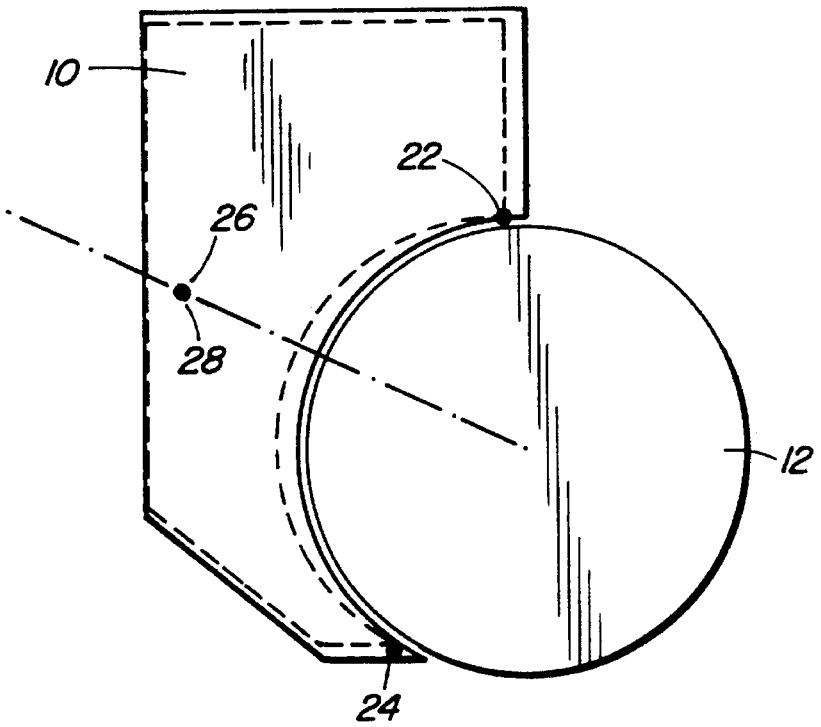
FIG. 4 is a view similar to FIG. 1 and illustrates the concept of the thermal expansion guiding system according to the invention.

FIG. 4 illustrates the concept of circumferential support for the hood internals incorporating thermal expansion guides according to the invention. The guiding system illustrated in FIG. 4 incorporates upper and lower guides 22 and 24 located at the ends of the hood wrap and guides 22 and 24 can accommodate circumferential movement but not radial movement. A further guide, 26, can accommodate radial movement but not circumferential movement. This ensures that circumferential support is used to control not only the profile of the hood internals but also the general thermal expansion of the hood. Guide 26 is located near the angular center 28 of the hood wrap such that it is circumferentially fixed relative to the cylinder 12. It restricts movements along the circumference but allows movements along the radius, thus minimizing displacement due to thermal expansion.

It will be appreciated that the guiding systems referred to in FIGS. 2, 3 and 4 are applicable to the internal system of the hood which are decoupled from the outside walls of the hood to reduce stresses. The thermal stresses in such structures occur when the temperature is not the same throughout the assembly. Different pieces have different expansion rates and this can cause stress at their common joints.

The nozzle box profile according to the invention is manufactured to a calculated shape which will result in a uniform, hot impingement distance, the distance will of course be greater at the angular center of the hood wrap when the hood is cold. The hood has a cool outer structure which is insulated on the inside, and is only structurally connected to the hot internals at the points described.

FIGS. 5 through 12 illustrate one example only of hood support points and show where the supports may be located in respect to crescent headers of the system and the movement that the support points allow.

Figure 5:
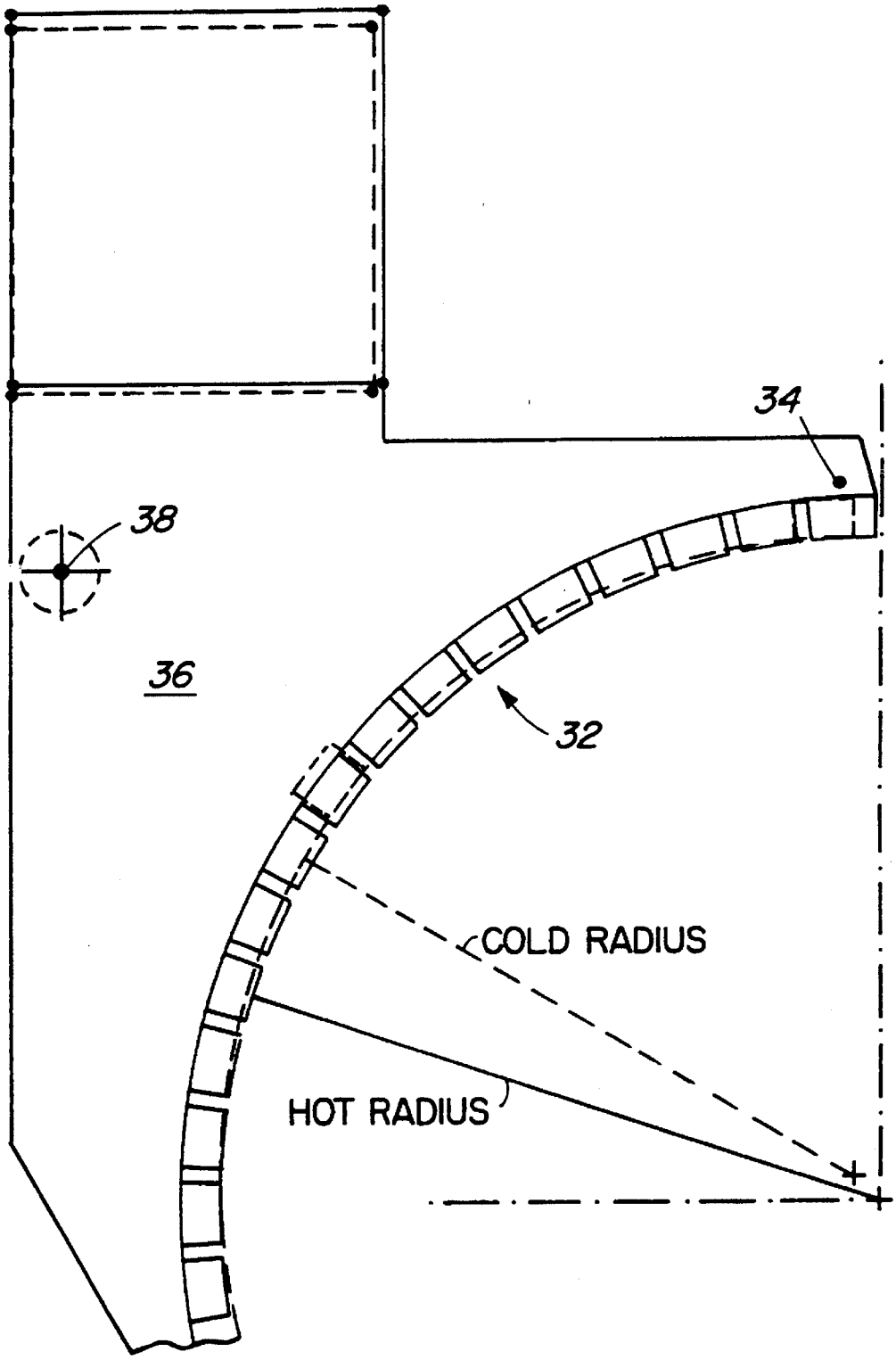
FIG. 5 is a fragmentary schematic view of a further embodiment of the invention.

As shown in FIGS. 5 and 6, the outer cold hood structure 30 constitutes the enclosure which covers the assembly on all sides with the exception of the concave face 32 which is opened to the internal or hot structure. The openings 34 provided in the outside structure are slot-shaped to allow displacement of the hood in a given direction. In this regard, note the opening 34 in the side of the hood 30 in FIG. 6 and the slotted arrangements in FIGS. 7–10.

A further type of arrangement is illustrated in FIGS. 5 and 6 to accommodate situations where a bottom guiding system as in FIGS. 2 and 4, cannot be installed. In this arrangement, along the radial displacement direction on the crescent headers 36, there is a "neutral" supported point 38 which is subjected to practically no displacement. In this arrangement, that specific, neutral supported point, would become a fixed support point. The top sliding guide 34 would remain, the bottom one would be eliminated.

Figure 8:
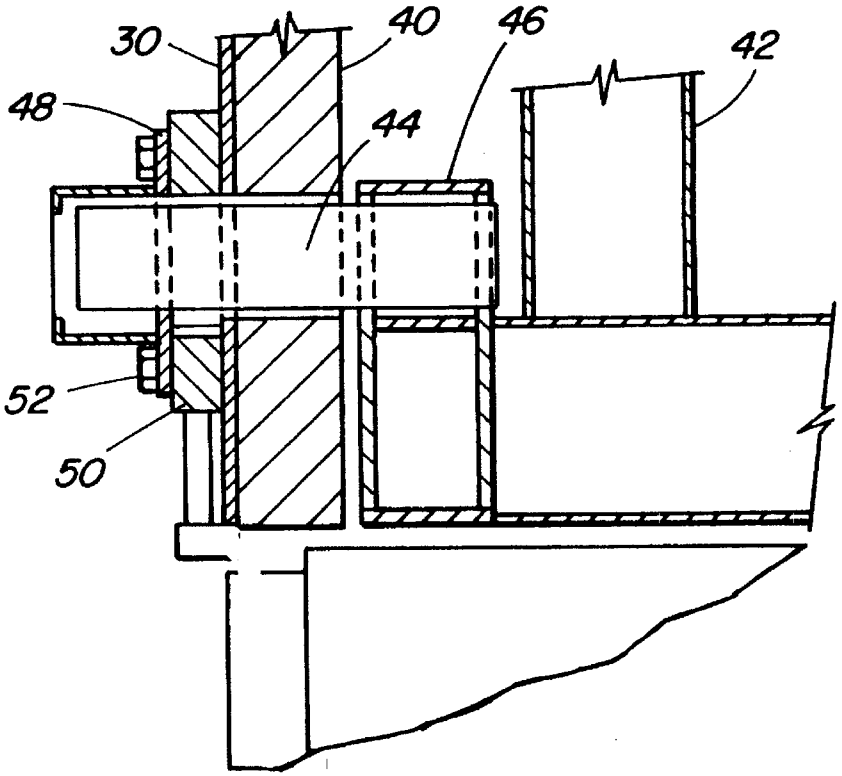
FIG. 8 is a cross-section of the assembly in FIG. 7.
Figure 7:
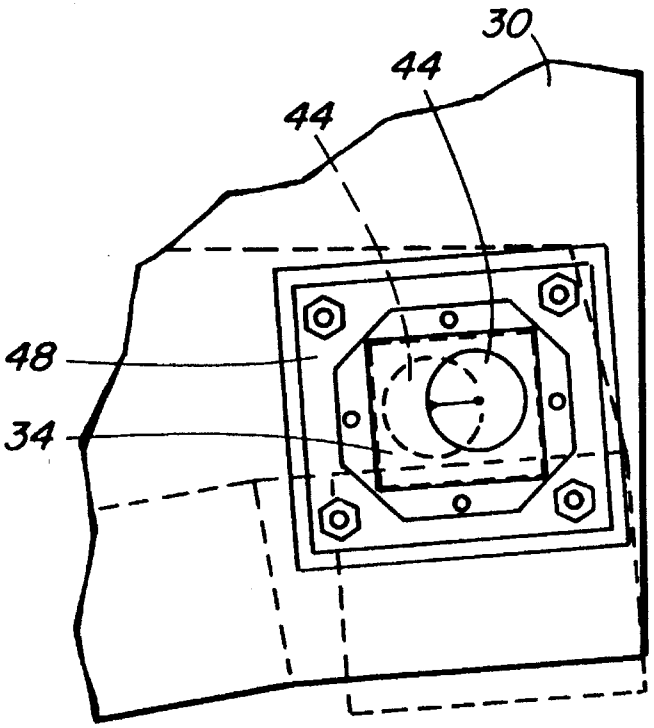
FIG. 7 is an end view of one example of a top sliding guide on the tending or hot side of the assembly.
Figure 10:
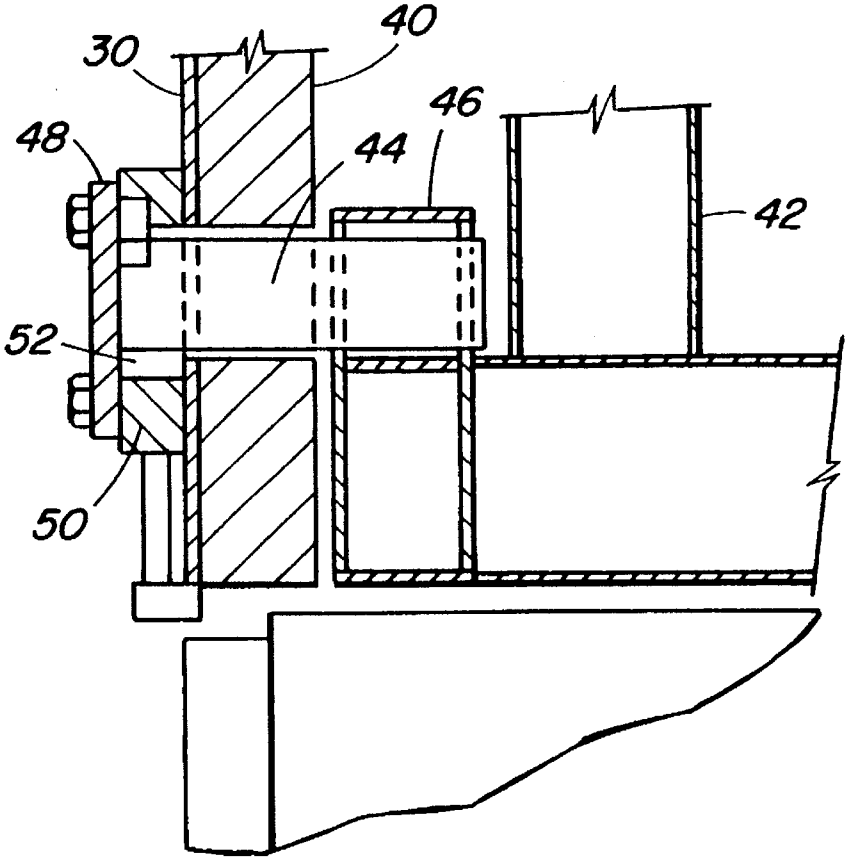
FIG. 10 is a cross-sectional view of the guide shown in FIG. 9.
Figure 9:
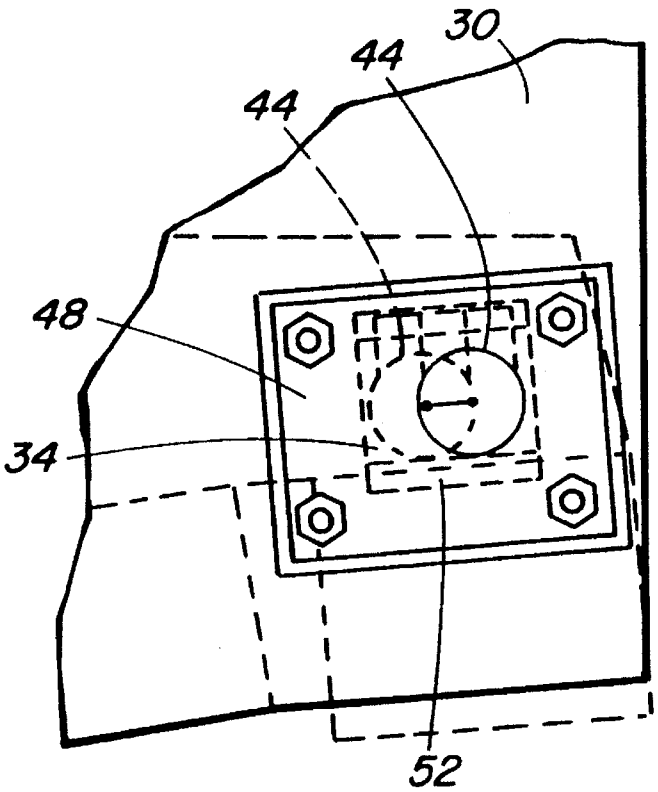
FIG. 9 is an end view of one example of a top sliding guide on the drive side of the hood.

The top sliding guide (34 in FIG. 6) is shown in greater detail in FIGS. 7 and 8 on the tending side and in FIGS. 9 and-10 on the drive side. As illustrated, the outer hood 30 is provided with insulation 40 on its inner surface thereof and the framework 42 of the internal structure of the hood provided with a support pin 44 secured on the inside of the hood to a frame member 46 and extending outwardly through the hood 30 by way of the aperture 34 therein. The outer end of the pin 44 is enclosed by means of a suitable plate member 48 which is detachably secured to a collar 50 that is provided with a suitable bearing surface 52 that carries the support pin 44 and which allows it to move backward and forward in the slot 34 depending on its expansion or contraction responsive to temperature changes. FIGS. 7 and 8 indicate the hot position of the pin 44 in full line and the cold position of the pin 44 in dashed line.

Figure 12:
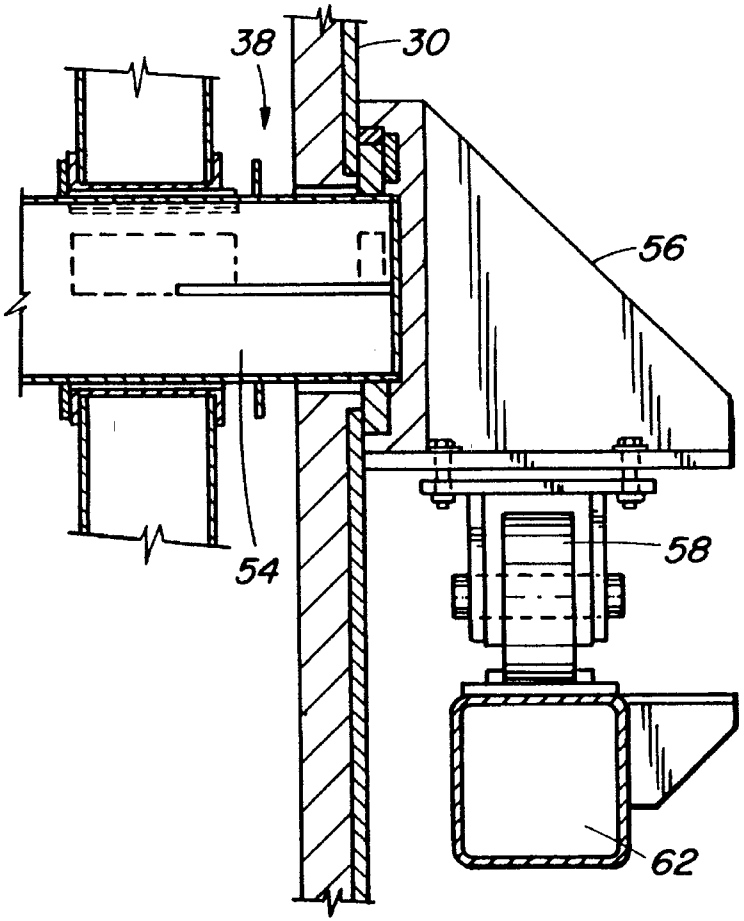
FIG. 12 is a cross-sectional view of the support structure shown in FIG. 11.
Figure 11:
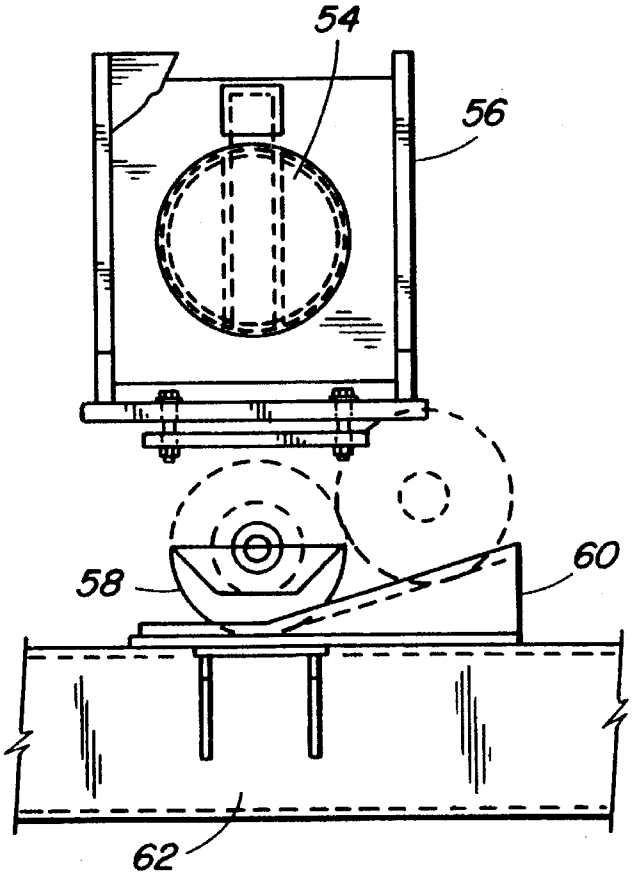
FIG. 11 is an end view of one example of the neutral point support arrangement.

FIGS. 11 and 12 are side and cross sectional views respectively of one example of the neutral supported point 38 shown in FIGS. 5 and 6.

Hood 30 carries the crescent header support 54 at the neutral point 38 by means of an aperture in the wall of the hood, the latter being provided with a bracket assembly 56 that includes a roller structure 58 secured to the lower end of the bracket, the roller structure being adaptable to movement on a ramp 60 which forms part of the frame structure 62.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

I claim:

1. A Yankee type drying hood structure adapted for mounting adjacent the surface of a cylinder, said hood including an internal mechanism with an air distribution and drying system therein and being decoupled from the outside walls of said hood, said internal mechanism having a deformed, cold profile; a guidance system for supporting said internal mechanism at or adjacent the extremities of the hood wrap to prevent interference between said hood and said cylinder; said guidance system comprising at least upper guides located at or adjacent the upper end of said hood wrap, said hood wrap ends being closest to the surface of said cylinder, the arrangement being such that the internal mechanism of said hood is adjusted to said deformed profile when cold so that, when the operative temperature of said hood is reached, a hot profile is assumed by said internal mechanism to provide a stable hood with controlled impingement distances at operating temperatures.

2. A hood structure according to claim 1 wherein said structure includes a neutral support point subject to little or no displacement, said upper guides providing sliding support points for said internal mechanism.

3. A Yankee type drying hood structure adapted for mounting adjacent the surface of a cylinder, said hood including an internal mechanism with an air distribution and drying system therein and being decoupled from the outside walls of said hood, said internal mechanism having a deformed, cold profile; a guiding system for supporting said internal mechanism at or adjacent the extremities of the hood wrap to prevent interference between said hood and said cylinder; said guidance system comprising upper guides and lower guides located at or adjacent each end of said hood wrap, said hood wrap ends being closest to the surface of said cylinder, the arrangement being such that the internal mechanism of said hood is adjusted to said deformed profile when cold so that, when the operative temperature of said hood is reached, a hot profile is assumed by said internal mechanism to provide a stable hood with controlled impingement distances at operating temperatures.

4. A Yankee type drying hood structure adapted for mounting adjacent the surface of a cylinder, said hood including an internal mechanism with an air distribution and drying system therein and being decoupled from the outside walls of said hood, said internal mechanism having a deformed, cold profile; a guiding system for supporting said internal mechanism adjacent the extremities of the hood wrap to prevent interference between said hood and said cylinder; said guidance system comprising upper guides and lower guides located adjacent each end of said hood wrap, said hood wrap ends being closest to the surface of said cylinder, the arrangement being such that the internal mechanism of said hood is adjusted to said deformed profile when cold so that, when the operative temperature of said hood is reached, a hot profile is assumed by said internal mechanism to provide a stable hood with controlled impingement distances at operating temperatures and wherein said upper and lower guides located adjacent the ends of the hood wrap can accommodate circumferential movement of the internal mechanism relative to said cylinder; and a further guide member located adjacent the angular center of said hood wrap and circumferentially fixed relative to said cylinder, said further guide member restricting movement of said hood structure circumferentially but allows radial movement of the hood structure relative to said cylinder to minimize displacement due to thermal expansion.

* * * * *